United States Patent [19]

Arnold, deceased et al.

[11] 4,117,492

[45] Sep. 26, 1978

[54] LOW PROFILE REMOTELY TUNED DIPOLE ANTENNA

[75] Inventors: James J. Arnold, deceased, late of Farmingdale, N.J., by Susan Arnold, executrix; Donn V. Campbell, Eatontown, N.J.

[73] Assignee: The United States of America as represented by the Secretary of the Army, Washington, D.C.

[21] Appl. No.: 819,194

[22] Filed: Jul. 26, 1977

[51] Int. Cl.[2] ..... H01Q 9/16

[52] U.S. Cl. ..... 343/747; 343/792

[58] Field of Search ..... 343/747, 792, 752, 885

[56] References Cited

U.S. PATENT DOCUMENTS 3,961,331 6/1976 Campbell ..... 343/792

*Primary Examiner*—Eli Lieberman

*Attorney, Agent, or Firm*—Nathan Edelberg; Sheldon Kanars; Bernard Franz

[57] ABSTRACT

A center-fed VHF dipole antenna structure particularly adapted for 30–80MHz operation wherein one half of the radiating structure comprises the outer conductor of a coaxial feedline which includes a low-loss cable choke at the lower end of the half dipole length of the feedline while the other half of the dipole consists of a conventional radiating conductor element. Additionally, remotely controlled variable impedance elements are included at the feedpoint to provide selective coarse and fine tuning of antenna resonance.

14 Claims, 6 Drawing Figures

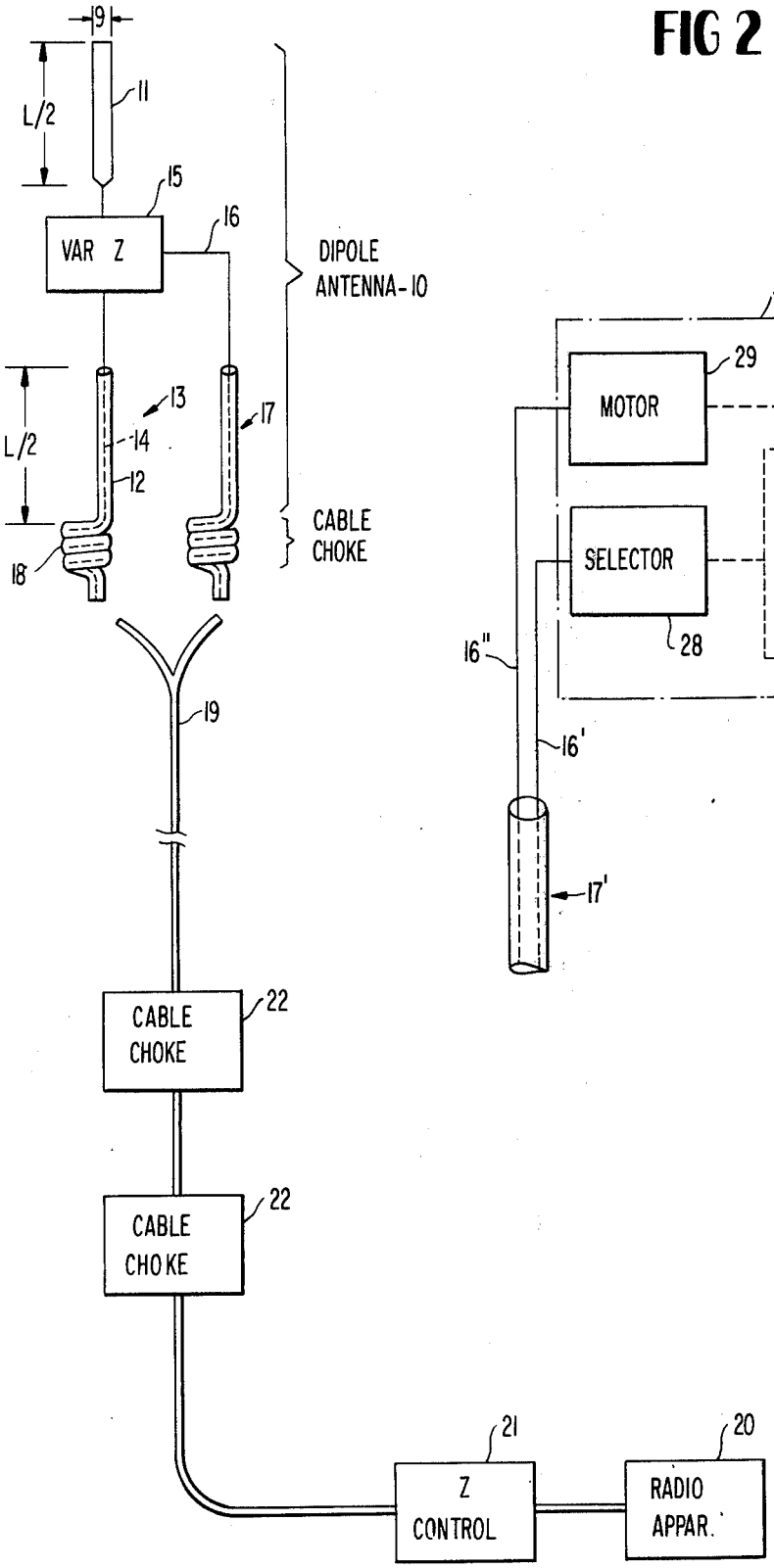
FIG 1
FIG 2
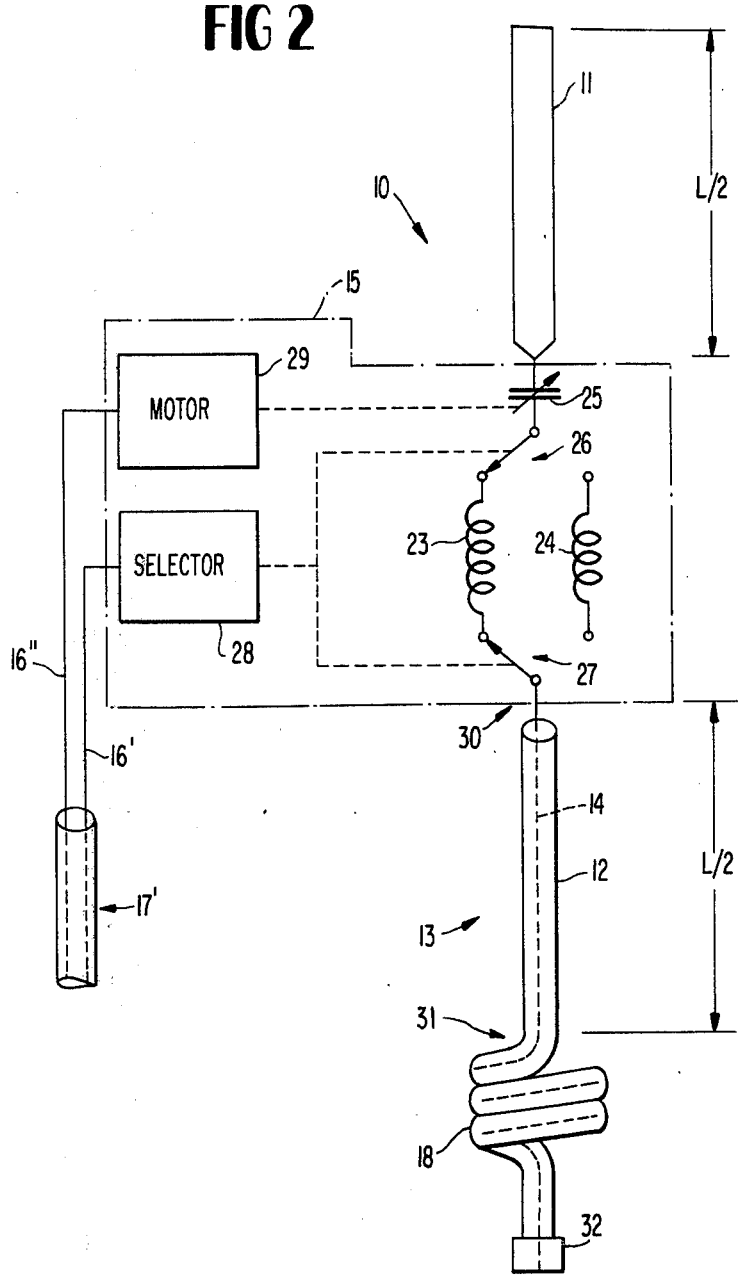

LOW PROFILE REMOTELY TUNED DIPOLE ANTENNA

The invention described herein may be manufactured and used by or for the Government for governmental purposes without the payment of any royalties thereon or therefor.

BACKGROUND OF THE INVENTION

The present invention relates generally to antennas of electromagnetic radiation and more particularly to dipole antennas whose length dimension is a small fraction of the wavelength at the frequency of operation. Electrically small antennas are of great importance for military use because they provide adequate electrical performance without the inconvenience often associated with full sized antennas. It is additionally well known that high antenna efficiency is a desirable quality; however, when the antenna is physically much shorter than the electrical length at resonance, the efficiency tends to be lowered due to the power losses occurring in the tuning and resonating elements normally required for proper operation. Remotely tuned electrically short antenna systems are well known to those skilled in the art. For example, U.S. Ser. No. 470,777 filed on May 15, 1974, now U.S. Pat. No. 3,909,830, and entitled "Tactical High Frequency Antenna", Donn V. Campbell, discloses one such apparatus; however, such apparatus is directed to a relatively short inductively loaded bottom fed radiating element having a single capacitive top termination connected to the upper extremity. Center fed dipole antennas including one or more feedline cable chokes associated therewith are also known. Such apparatus is shown for example in U.S. Pat. No. 3,879,735, entitled "Broadband Antenna System With Isolated Independent Radiators", Donn V. Campbell, et al. which issued on Apr. 22, 1975. In addition, multiport cable chokes are also known. Such apparatus for example is disclosed in U.S. Ser. No. 614,283 filed Sept. 17, 1975, now abandoned, entitled "Multiport Cable Choke", J. Arnold, et al. This constitutes known prior art in this invention which is directed to an improvement thereover.

SUMMARY

The subject invention is directed to an improvement in dipole antenna systems which are adapted to be remotely tuned and comprises a center fed dipole which has remotely controlled variable impedance means connected in series with the feedpoint. The dipole consists of first and second radiator elements respectively comprised of a relatively short conductor and the outer conductor of the feed transmission line which additionally includes a cable choke therein at the terminal end of the outer conductor dipole element. The variable impedance consists of an inductor-capacitor combination, either or both of which are variable and capable of being controlled from a location remote from the antenna itself.

BRIEF DESCRIPTION OF THE DRAWINGS

FIG. 1 is an electrical schematic partially in block diagrammatic form illustrative of the essential features of the antenna comprising the subject invention;

FIG. 2 is an electrical block diagram further illustrative of the antenna shown in FIG. 1;

DESCRIPTION OF THE PREFERRED EMBODIMENTS

Figure 3:
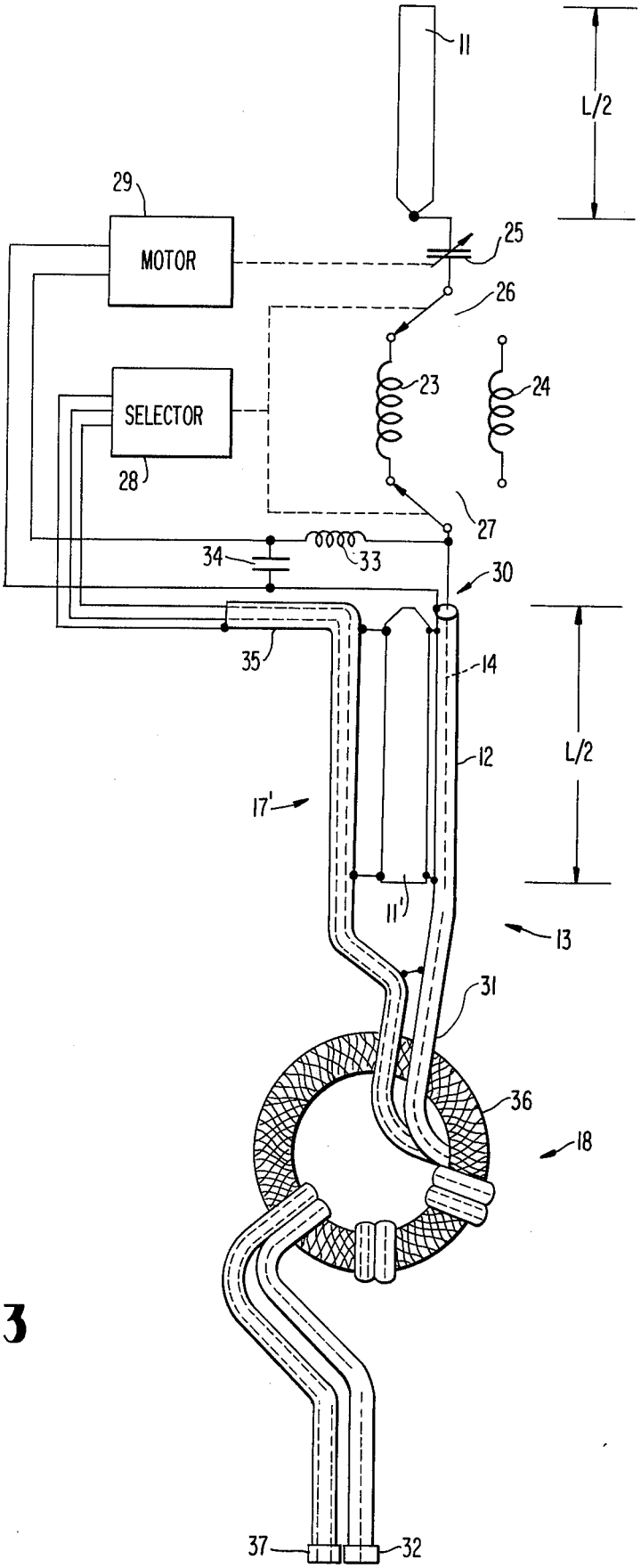
FIG. 3 is an electrical schematic diagram illustrative of another embodiment of the subject invention.

Referring now to the drawings wherein like numerals refer to like parts, attention is directed first to FIG. 1, wherein reference numeral 10 denotes a dipole antenna which includes two linearly aligned radiating elements 11 and 12. The element 11 consists of a relatively short conductor member of conventional design whose cross-sectional dimension "*a*" is substantially less than its length L/2. The other radiating element 12 consists of the outer conductor also of a cross-sectional dimension "*a*" of the signal feed transmission line 13 whose inner conductor 14 is adapted to center feed the antenna 10 by being coupled to a variable electrical impedance subassembly 15, which is controlled for example by means of an electrical signal applied thereto from the center conductor 16 of a coaxial control cable 17. The feed transmission line 13 is additionally configured into a low-loss cable choke 18 at the end termination of the L/2 dipole portion of the outer conductor 12. The control cable 17 may or may not also include a cable choke section; however, the feed transmission line 13 and the control cable 17 form a composite cable 19 which is adapted to be connected to remotely located radio apparatus 20 and an antenna tuning control assembly 21 with a selected number of cable chokes 22 located at selected intervals along the composite cable 19 for suppressing radio frequency currents which may be induced on the outside of the transmission line 13 and the control cable 17. The control assembly 21 provides for manual or automatic control of the antenna 10 and additionally may include, if desired, an indicator, not shown, to inform the operator that the antenna is properly tuned-/untuned and ready/not ready to operate.

Referring now to FIG. 2, there is disclosed in greater detail the means 15 by which the antenna 10 shown in FIG. 1 is tuned, that is, resonated to its operating frequency. The variable impedance assembly 15 is shown comprising a plurality of fixed inductors 23, 24, selectively coupled in series with a variable capacitor 25 by means of a pair of single pole multi-position electrical switches 26 and 27 which are ganged together and physically operated by means of an electrically operated selector mechanism 28 operated in accordance with a signal coupled thereto from the inner conductor 16' of a coaxial control cable 17' which additionally includes a second inner conductor 16'' which is used to operate an electric motor 29 e.g. a reversible gear motor or step motor, for example, which is mechanically coupled to the variable capacitor 25. This is shown by way of illustration only and is not meant to be interpreted in a limiting sense, since when desirable, other types of apparatus other than electrical, namely mechanical, hydraulic or pneumatic apparatus can be utilized to activate the switches 26 and 27 and the variable capacitor 25.

The inner conductor 14 of the feedline 13 being connected to the switch 27 thereby acts to center feed the antenna 10 at the point 30 since the upper radiating element 11 is connected to the variable capacitor 25. As noted, the lower end 31 of the outer conductor antenna element 12 which is at the lower end of the antenna assembly is formed into the cable choke 18. It in turn is fitted with a suitable RF connector 32 for connection to the composite cable 19 shown in FIG. 1.

The low loss cable choke 18 is suitably proportioned so as to provide a very high impedance to the radio frequency current flowing along the outer conductor 12. When the impedance of the cable choke 18 is sufficiently high, then the amplitude of the radio frequency current at the lower end 31 of conductor antenna element 12 which is also at the top of the choke 18 will be very small in comparison to the amplitude of the radio frequency current near the feedpoint 30. This is highly desirable, since it greatly reduces excitation of radio frequency current on the outer conductor of the composite feed and control cable 19, between the RF connector 32 and the radio apparatus 20 (FIG. 1) which is located some distance from the antenna 10. It is desirable to suppress radio frequency currents on the outer conductor below the RF connector 32, because such an extraneous current cannot only seriously distort the radiation pattern of the antenna, but decrease the antenna efficiency as well as spoil the impedance of the antenna, and additionally cause erratic operation of the radio apparatus 20 itself.

In the present invention, the antenna 10 is preferably resonated by the combination of one of the fixed inductances 23, 24 and the variable capacitance 25. If the tuning capacitor 25 is set to its maximum value, $C_{max}$, the antenna 10 will then resonate at the low frequency limit $f_L$ according to the following expression:

$$f_L = 1/2\pi \sqrt{1/L\,(1/C_A + 1/C_{max})} \quad (1)$$

where $L$ is the inductance of the inductor 23, 24 selected and $C_A$ is the antenna "capacitance". In a like manner, when the tuning capacitor 25 is set to its minimum value, $C_{min}$, the antenna 10 will then resonate at the upper frequency limit $f_U$, which is defined as:

$$f_U = 1/2\pi \sqrt{1/L\,(1/C_A + 1/C_{min})} \quad (2)$$

The antenna 10 can be resonated at any frequency intermediate $f_L$ and $f_U$ by setting the tuning capacitor 25 at an appropriate intermediate setting.

As an illustrative example, assuming that the antenna 10 has a capacitance $C_A = 5$pF(picofarads) and that the tuning capacitor 25 can be continuously varied between a minimum value $C_{min} = 8$pF and a maximum value $C_{max} = 100$pF, it then can be shown that the ratio of upper frequency $f_U$ to lower frequency $f_L$ is in the order of 1.24.

It is obviously impossible using a single inductor, for example, inductor 23 to resonate the antenna 10 over a frequency range for example 30 to 80MHz. However, by including at least a second inductor 24 having a suitable inductance different from that of inductor 23, it is possible to extend the tuning range as desired. If the second inductor 24 for example is chosen to have a smaller value than inductor 23, the antenna 10 may be tuned, for example, from 30 to 37.2MHz by varying the tuning capacitor 25 from its maximum value to its minimum value. Then if the second inductor 24 is switched into the circuit and its value chosen so that the antenna resonates at 37.2MHz when the capacitor 25 is set at its maximum value, the antenna may be tuned between 37.2MHz and 46MHz. This same procedure can be used to extend the tuning range by adding a third and fourth inductor or more as required to cover the contemplated frequency range. The number of inductors 23, 24 is equal to the number of bands needed to cover a specified frequency range. The tuning range in each band can be further estimated from the formula:

$$f_U/f_L = (f_{max}/f_{min})^{1/N} \quad (3)$$

wherein $f_{max}$ denotes the highest frequency, $f_{min}$ denotes the lowest frequency, and $N$ equals the number of bands. For example, if $f_{min} = 30$MHz, $f_{max} = 80$MHz, and $N = 6$, then the ratio of $f_U/f_L = 1.177$. Accordingly, the first band would extend from 30 to 35.33MHz, the second band from 35.33 to 41.6MHz, and so on. It is also possible to provide some overlap between ranges by proper dimensioning of the inductors and the capacitor 25.

Referring now to FIG. 3, there is disclosed another embodiment of the subject invention which is similar to that shown in FIG. 2, in that the upper radiating element 10 is coupled to a motor driven variable capacitor 25, series connected to a selected fixed inductor 23, 24. As before, one of the inductors 23 or 24 is connected into the circuit by means of selector 28 which is adapted to operate switches 26 and 27. In this embodiment, however, the signal feedline center conductor 14 is also adapted to transmit control signals for the motor 29. The control signals may be coupled into the feedline 13 for example by multiplexing and as a consequence, a low pass filter arrangement consisting of a radio frequency choke 33 and a by-pass capacitor 34 is also employed. One lead to the motor 29 is connected to the common connection between the choke 33 and the capacitor 34 while the other lead is connected to the outer conductor 12.

As before, one half of the dipole antenna consists in the outer conductor 12. In the instant embodiment, however, a second short conductor member 11' identical to the upper short conductor member 11 is electrically connected to the outer conductor 12 at both ends of the conductor 11' in the region of the feedpoint 30 and the top 31 of the cable choke 18. Additionally, the control cable 17' which is coupled to the selector 28 also has its outer conductor 35 connected to the radiating element 11' at each end thereof in the same fashion. The cable choke 18, however, is now shown comprised of coaxial cables 13 and 17' being wound side by side with the same number of turns on a core 36. The core 36 is preferably comprised of ferrous material such as powdered iron or ferrite to achieve high inductance with few turns; however, this is not critical inasmuch as it may be composed of non-ferrous and non-conducting material when desired. Furthermore, although the core 36 is illustrated as being toroidal, it may, when desired, be configured in a cylindrical form, as suggested in FIG. 1 and may also include a cylindrical ferrous core.

It is important to note that the connections of the outer conductors 12 and 35 to the short conductor 11' near its top and bottom insure that the cables and antenna conductor operate cooperatively, and furthermore, the cable choke 18 will then provide the necessary high impedance between the bottom of the conductor 11' and the connectors 32 and 37 associated with the feedlines 13 and 17'.

It should further be noted that the selector 28 and the motor 29 can be physically located in any convenient position along the antenna 10. For example, the motor 29 could be located at the bottom of the antenna near the cable choke 18 and a mechanical linkage provided to activate the tuning capacitor 25 located near the mid-point of the antenna.

Figure 4:
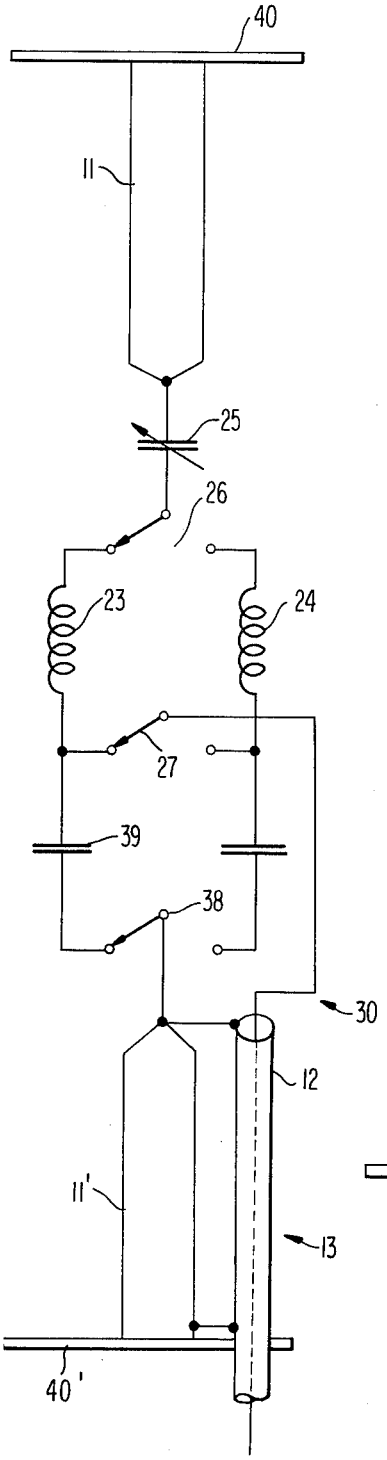
FIG. 4 is an electrical schematic diagram illustrative of yet another embodiment of the subject invention.

The description of the antenna according to the subject invention thus far has not taken into consideration the matter of impedance matching. Because the antenna resistance is small at resonance, the transmission line may be poorly matched. One way to provide for impedance matching is to utilize the configuration shown in FIG. 4. Referring now to FIG. 4, an additional electrical switch 38 is included and a matching capacitor 39 is adapted to be connected from the feedpoint 30 to the end of short conductor element 11' which by proper selection of the capacitance value the impedance of the antenna 10 can be better matched to the characteristic impedance of the feed transmission line 13.

The configuration shown in FIG. 4 also illustrates additional capacitive loading conductor elements 40 and 40' being connected to the outer extremities of the opposing conductors 11 and 11'. The conductors 40 and 40' may take the form of cylinders, discs, spheres, umbrellas or any other convenient shapes. The details relating to control means for operating the switches 26, 27 and 38 are deleted for purposes of clarity, inasmuch as such apparatus has previously been disclosed, for example with respect to the embodiments shown in FIGS. 2 and 3.

Figure 5:
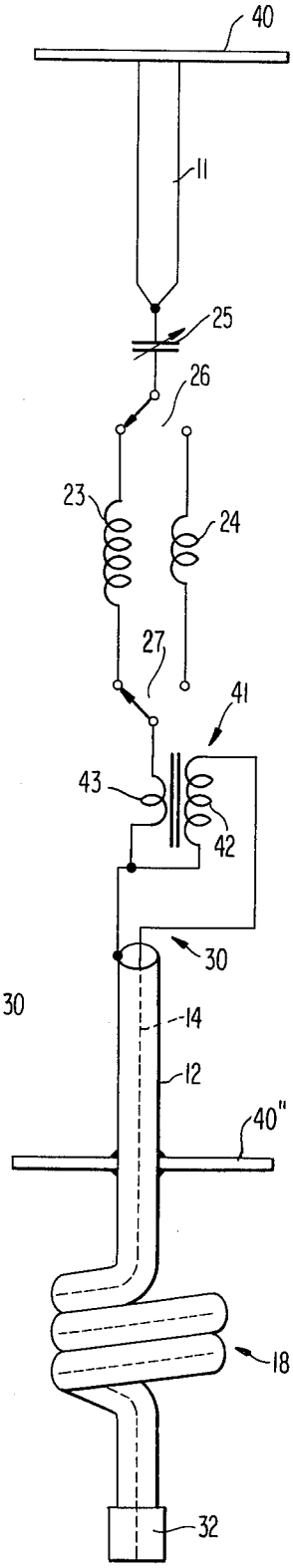
FIG. 5 is an electrical schematic diagram further illustrative of still another embodiment of the subject invention.

Impedance matching can also be obtained by means of a broadband transformer connected between the feedpoint 30 and the radiating elements 11 and 12. To this end, reference is now made to FIG. 5, which is similar to the embodiment shown in FIG. 2, except that an impedance matching transformer 41 has one winding 42 connected across the outer conductor 12 and the inner conductor 14. The other winding 43, on the other hand, is connected between the outer conductor 12 and the switch 27. Additionally, the embodiment shown in FIG. 5 resembles the embodiment of FIG. 4 in that capacitive loading elements are additionally included. Specifically loading element 40' is connected to the upper extremity of conductor element 11 as before; however, the conductor 11' of FIG. 4 is omitted but a capacitive loading element 40'' is connected to the outer conductor 12 as shown since the outer conductor 12 is the only lower dipole radiating element utilized. Below the capacitive loading element 40'' is cable choke 18 which feeds into the connector 32. Again, the means for controlling the switching elements 26 and 27 as well as controlling the variable capacitor 25 is not shown for reasons stated above.

Figure 6:
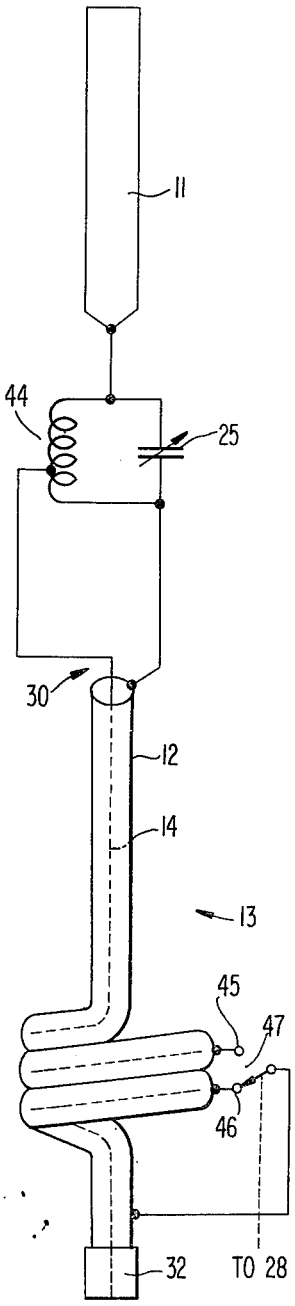
FIG. 6 is an electrical schematic diagram still further illustrative of another embodiment of the subject invention.

Finally, the last embodiment of the subject invention disclosed is illustrated in FIG. 6. Referring now to FIG. 6, it is similar to the embodiment shown in FIG. 2 with the exception that the tuning circuitry at the feedpoint 30 comprises a parallel combination of variable capacitor 25 and an inductor 44. Additionally, the cable choke 18 is provided with a number of taps, for example taps 45 and 46, which are coupled to a remotely controlled switch 47. The taps 45 and 46 are connected to the outer conductor 12 on the lower side of the cable choke 18 formed from the feedline 13 so that selected winding(s) of the cable choke can be shorted which thus permits the resonance frequency of the cable choke 18 to be adjusted to coincide with or at least approximate the resonant frequency of the antenna 10. The tuning circuit shown in FIG. 6 is adapted to cover a broad frequency band. However, to achieve high efficiency, the capacitor 25 should have a small maximum value so as to reduce the circulating current in the inductor 44.

When desirable, the cable choke 18 shown in FIG. 6 could be configured as shown in FIG. 3. Cable chokes, moreover, have been made adjustable in various other ways. For example, note the teaching of U.S. Pat. No. 2,913,722, which issued on Nov. 17, 1959. The cable choke could also be made continuously adjustable by connecting it in parallel with variable inductors and/or variable capacitors.

Thus what has been shown and described is an electrically small dipole antenna which is particularly adapted but not restricted to operation in the VHF range existing between 30 and 80MHz, and which can be remotely tuned over this frequency range for the purpose of transmission or reception of electromagnetic energy. The small physical size is dictated by requirements for low visibility, light weight, and ease of deployment. The remote tuning feature permits optimization of antenna efficiency by adaptation to the environment and also increases the survivability of the radio operator in military situations. The narrow instantaneous bandwidth of the subject invention also facilitates installation and the proximity of other radio transmitter-receivers operating on adjacent radio frequencies. Also, because the antenna is remotely tuned, it adapts to its environment better than an untuned antenna. This feature results in increased efficiency. Moreover, the cable choke isolates the antenna from the transmission line and controlled cable and eliminates the need for a bulky ground plane.

Having thus shown and described what is at present considered to be the preferred embodiment of the subject invention, we claim:

1. A center-fed broadband dipole antenna system which is adapted to be remotely tuned for the transmission or reception of electromagnetic energy, comprising in combination:

a dipole antenna consisting of an electrically short, substantially less than a quarter wavelength, conductor element of a predetermined length and transverse cross-sectional width, and a length, substantially equal to said predetermined length, of outer conductor of a feed transmission line having an inner conductor and outer conductor, said conductor element and said length of outer conductor being mutually linearly opposed to one another at a feedpoint of said inner conductor;

said feed transmission line additionally being configured to include a cable choke section adjacent said length of outer conductor at the opposite end thereof from the feedpoint end; and remotely controlled variable impedance means electrically coupling said feedpoint to said dipole antenna for resonating said antenna to a selected operating frequency.

2. The system as defined by claim 1 wherein said remotely controlled variable impedance means includes electrically controlled means for varying the electrical impedance characteristic of said impedance means and additionally including an electrical cable having an outer conductor and at least one inner conductor connected between said electrical control means and a source of control signals remotely located from said dipole antenna.

3. The system as defined by claim 2 wherein said control cable includes a cable choke section adjacent said cable choke section of said feed transmission line.

4. The system as defined by claim 3 and additionally including another conductor element substantially identical to said first recited conductor element and being connected at its extremities to said length of outer conductor and to the outer conductor of said control cable.

5. The antenna system as defined by claim 1 wherein said variable impedance means includes first impedance means for providing coarse tuning of said dipole element and second impedance means for providing fine tuning of said dipole antenna.

6. The system as defined by claim 5 wherein said first impedance means comprises electrical reactance means of a first type and wherein said second impedance means comprises electrical reactance means of a second type.

7. The system as defined by claim 6 wherein said reactance means of said first type comprises inductive reactance means and wherein said electrical reactance means of a second type comprises capacitive reactance means.

8. The invention as defined in claim 7 wherein said inductive reactance means comprises a selected one of a plurality of switched inductances coupled to said capacitance reactance means and wherein said capacitive reactance means comprises a variable capacitor.

9. The system as defined by claim 8 wherein said selected one inductance and said variable capacitance are connected in series.

10. The system as defined by claim 9 and additionally including impedance matching means coupled to the series connection of said selected one inductor and said variable capacitance.

11. The system as defined by claim 1 and additionally including means for selectively varying the electrical characteristic of said cable choke section for adjusting the resonance frequency of the cable choke to coincide with or substantially approximate the resonance frequency of said dipole antenna.

12. The system as defined by claim 1 and additionally including loading means electrically connected to the outer end portion of said conductor element and said length of said outer conductor which operate as capacitance loads for increasing the antenna efficiency.

13. The system as defined by claim 1 and additionally including a second conductor element substantially identical to said first recited conductor element connected at its opposite ends to the opposite ends of said length of outer conductor.

14. The dipole system as defined by claim 1 wherein said length of outer conductor has a cross-sectional dimension substantially equal to said transverse cross-sectional width dimension of said conductor element.

* * * * *